US006120261A

United States Patent [19]

Al-Towailib

[11] Patent Number: 6,120,261

[45] Date of Patent: Sep. 19, 2000

[54] ELECTRIC SUBMERSIBLE PUMP WITH HOLLOW DRIVE SHAFT

[75] Inventor: Abdulazeem Abbas Al-Towailib, Qatif, Saudi Arabia

[73] Assignee: Saudi Arabian Oil Company, Dhahran, Saudi Arabia

[21] Appl. No.: 09/139,294

[22] Filed: Aug. 25, 1998

[51] Int. Cl.[7] ..... F04B 17/00

[52] U.S. Cl. ..... 417/356; 417/423.3

[58] Field of Search ..... 417/356, 373, 417/372, 423.3, 366; 415/155, 180

[56] References Cited

U.S. PATENT DOCUMENTS

| | | | |
|---|---|---|---|
| 2,531,120 | 11/1950 | Feaster | 255/4.8 |
| 3,183,384 | 5/1965 | Flaherty, Jr. et al. | 310/90 |
| 3,223,315 | 12/1965 | Smith | 233/24 |
| 3,228,597 | 1/1966 | Walker et al. | 233/24 |
| 4,098,359 | 7/1978 | Birdwell | 175/93 |
| 4,524,830 | 6/1985 | Williams | 166/321 |
| 4,930,996 | 6/1990 | Jensen et al. | 417/373 |
| 5,009,264 | 4/1991 | Sliger et al. | 166/106 |
| 5,226,483 | 7/1993 | Williamson, Jr. | 166/375 |
| 5,253,706 | 10/1993 | Reid | 166/135 |
| 5,549,447 | 8/1996 | Bevington | 415/115 |
| 5,700,138 | 12/1997 | Bevington | 417/366 |
| 5,979,559 | 11/1999 | Kennedy | 166/369 |

*Primary Examiner*—Henry C. Yuen
*Assistant Examiner*—Mahmoud M Gimie
*Attorney, Agent, or Firm*—Abelman, Frayne & Schwab

[57] ABSTRACT

A combined electric motor and submersible pump apparatus intended for installation in line with the well tubing has a hollow drive shaft the down stream end of which is secured to the rotor of the motor and mounted for rotation in axial alignment with the axis of the tubing, the pump impellers being mounted on the upstream end of the hollow shaft, the shaft also having inlet and discharge ports and a check valve mounted on the interior of the drive shaft that is closed when the pump is activated. When the check valve is in the open position, a wire line tool or the like can be passed through the hollow drive shaft to a position below the apparatus.

32 Claims, 1 Drawing Sheet

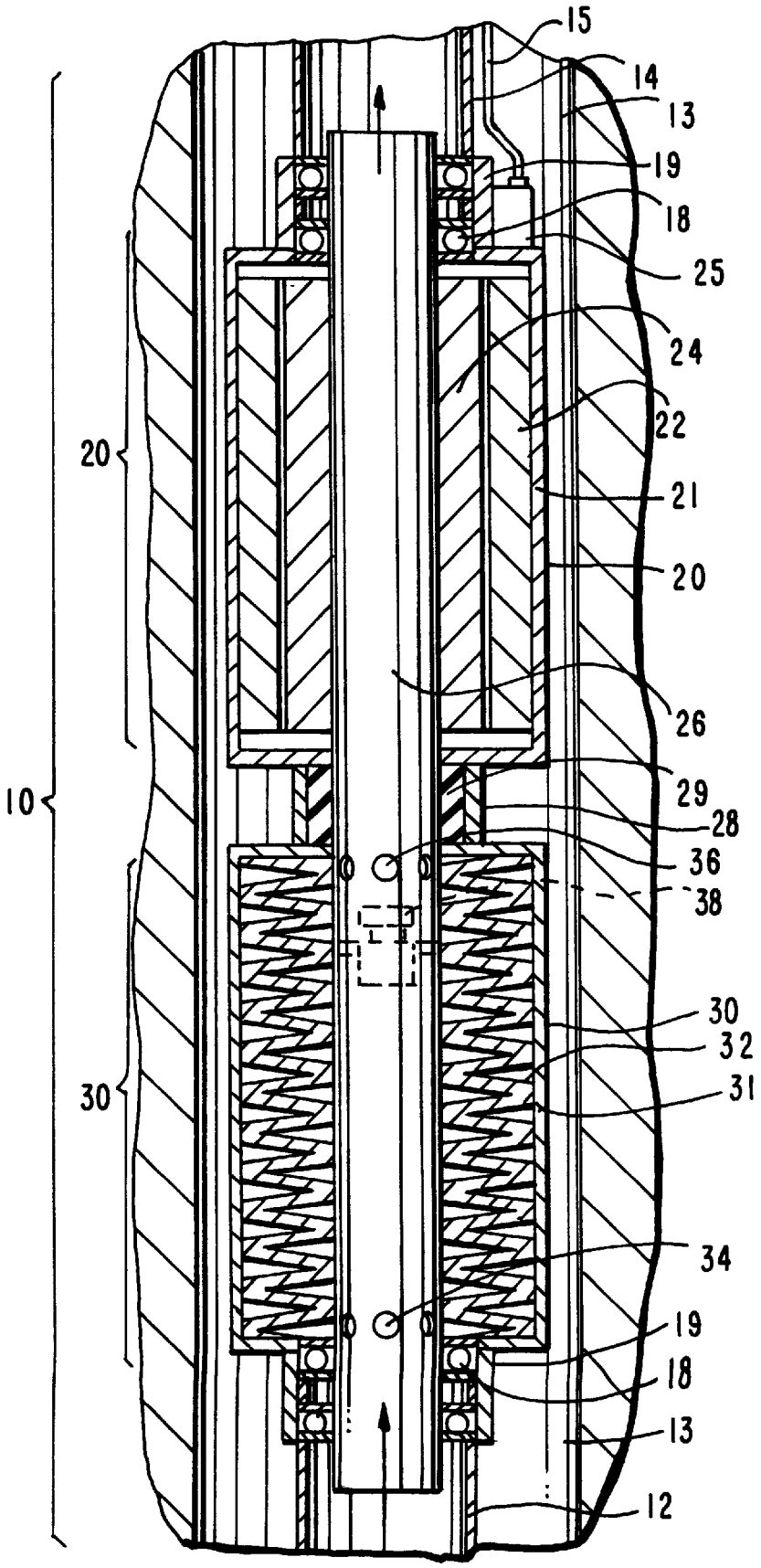
15
14
13
19
18
25
24
22
21
20
26
29
28
36
38
30
32
31
34
19
18
13
12
20
10
30

ELECTRIC SUBMERSIBLE PUMP WITH HOLLOW DRIVE SHAFT

FIELD OF THE INVENTION

The invention relates to electric submersible pumps for use in well tubing, for example, in oil field well bores.

BACKGROUND OF INVENTION

Electric submersible pumps installed in-line on well tubing strings present problems in well monitoring and treatment. Wire line tools, coiled tubing and other devices cannot be lowered to the production interval below the pump due to the presence of the pump/motor assembly in the well bore.

In order to permit passage of wire line tools and the like, Y-shaped bypass pump assemblies have been developed. However, these bypass assemblies can only be accommodated in well casings that are substantially larger than the standard oil casings presently employed in oil fields throughout the world. The cost of retrofitting a well with the 9⅝" casing required to install a Y-shaped bypass assembly is estimated to be approximately one million dollars.

It is therefore one principal object of this invention to provide an electric submersible pump that can be installed in existing well bores and that will permit the passage of wire line logging tools and other devices that are required to monitor and maintain the well tubing and casing string.

It is another object of the invention to provide an electric submersible pump that can be installed in-line with the production tubing and that can be coupled to standard sections of tubing pipe.

Another object of the invention is to provide an electric submersible pump that is of durable construction, that will provide a long service life with minimum maintenance and that is relatively simple and economical to install in new and existing well casings.

Another object of the invention is to provide a method and apparatus for use in wells in which a submersible electric motor and pump assembly are installed on a hollow shaft that is axially aligned with the pipe through which the fluid drawn from the well passes, where the hollow shaft will freely permit the passage of devices lowered from a position above the pump assembly to the production interval below the pump.

SUMMARY OF THE INVENTION

The above objects, and other advantages will be realized from the improved electric submersible pump of the invention which provides an axial flow path through the motor's drive shaft for the fluid discharged from the pump and a contiguous axial path through the pump's housing or case that can be moved from a normal closed to an open position to permit the passage of wire line logging tools and other devices. The motor elements and pump elements are mounted in tandem on a rotatable hollow drive shaft which extends axially through the motor and pump housings. A check valve or operable plug is positioned in the axial flow passage between the pump intake and discharge positions as a one-way valve against the back pressure from the pump.

The electrical submersible pump of the invention can be located at the end of the tubing string, in which case it will be secured to a tail pipe section. Alternatively, the pump can be located at intermediate positions on the tubing string.

In a preferred embodiment, the pump and motor housings are secured to upstream and downstream ends of standard pipe sections forming the well tubing string by bearing seals which support the hollow drive shaft for rotation. The pump and motor housings can be produced as separate or integral elements, and if integral, can incorporate a journal and bearing at their interface to further support the hollow shaft for rotation.

The downstream end of the hollow shaft is in fluid communication with the interior of the down hole tubing string. The intake port for the pump can be a plurality of orifices in the hollow drive shaft that are positioned adjacent to the pump impellers at the low pressure end of the pump housing. The fluid drawn into the pump moves upwardly in the space defined by the pump housing or case and the hollow drive shaft and passes back into the drive shaft through a plurality of orifices comprising the discharge or outlet ports at the high pressure end of the pump. The pressurized fluid then continues through the drive shaft in the motor and into the downstream tubing string. In the embodiment illustrated, the outside diameter of the end of the hollow drive shaft is less than the inside diameter of the adjacent end of the tubing section.

In order to prevent the discharge from the pump from flowing back down the hollow shaft to the pump intake port, a check or plug valve is positioned in the shaft between the pump intake and discharge ports. A device such as a landing nipple can be advantageously employed, and various types of commercially available landing nipples that are known in the oil field art can be adapted for use in the invention. The landing nipple is provided with a valve member that is normally closed to prevent the passage of fluid through the well bore or tubing and the valve member opens in response to associated control means, the operation of which can be directed from the earth's surface at the well head.

In a preferred embodiment, the pump and motor of the invention are assembled to a plug landing nipple which comprises the hollow draft shaft extending through the motor and pump. In this embodiment, the landing nipple is provided with bearing seals proximate its ends that permit its rotation with respect to the pump and motor housings and the up-and-downstream ends of the tubing string. The landing plug can be opened and closed in response to electrical signals carried by conductor cables from surface control means, or by mechanical means, both of which plug activator means are well-known to the art. Alternatively, the valve closure member can be moved in response to the axial rotation of the drive shaft in which the valve member is located. For example, the valve can be caused to maintain the sealed position when the shaft is rotating.

The method of the invention for installing the improved electrical submersible pump in a tubing string which permits the passage of wire guide tools to a position upstream of the pump comprises the steps of:

a) providing an electric submersible pump and motor of generally cylindrical configuration, each having a maximum outside diameter less than the inside diameter of the well casing, said pump having a hollow drive shaft extending from the motor and a concentrically mounted rotor and pump impellers, a check valve mounted on the interior of the hollow drive shaft between the pump intake and pump discharge, said check valve being in a closed position when the pump is operating, said hollow drive shaft having inlet ports in fluid communication with the inlet of the pump and outlet ports in fluid communication with the discharge of the pump;

b) providing activation means in association with the check valve to move the check valve from a closed to an open position;

c) providing electrical conductors to the motor;

d) assembling the upstream end of the hollow drive shaft for rotational movement in axial alignment to the free end of a down-hole tubing string projecting from the well casing;

e) assembling the end of the hollow drive shaft that is downstream of the pump for rotational movement in axial alignment to one end of a second length of tubing;

f) securing the pump and motor to the ends of the adjacent sections of tubing; and g) lowering the assembled tubing string and electric submersible pump into the well casing, whereby the check valve can be opened to permit the passage of wire-guide tools through the hollow drive shaft of the electric submersible pump.

The method further comprises cooling the motor by direct or indirect heat exchange with the fluid that is drawn from the well and that passes through the tubing string and drive shaft. Indirect cooling of the motor is accomplished through heat exchange with a heat transfer fluid circulating in a sealed system that comprises a heat exchanger.

The elements comprising the electrical submersible pump are fabricated from high strength corrosion-resistant steel alloys and engineering plastics that are machined or molded to the required configurations and tolerances.

From the above description, it will be understood that use of the present invention in new well construction and in the retrofitting of existing wells permits well monitoring and treatment work to be undertaken without retrieving the electric submersible pump and without the installation and use of large bypass assemblies. Retrofitting can be completed within the existing industry-standard 9⅝" well casing.

BRIEF DESCRIPTION OF THE DRAWINGS

FIG. 1 is a fragmented, longitudinal sectional view of a submersible pump made in accordance with the preferred embodiment.

DESCRIPTION OF PREFERRED EMBODIMENT

The drawing depicts a first section 12 of a vertical well pipe or tubing string, (such as that used in an oil well), that has been assembled with an electric submersible pump 10 of the invention. The electric submersible pump is comprised of two principal elements, these being the drive motor 20 and the pump 30. The drive motor 20 is comprised of an annular stator 22 and a concentric rotor 24 that is secured to hollow drive shaft 26. The lower or upstream end of drive shaft 26 is attached to annular pump impellers 32 and includes lower intake ports 34 and upper discharge ports 36. As schematically illustrated, drive shaft 26 is preferably of one-piece construction for reasons of simplicity and economy. Alternatively, shaft 26 can be constructed of separate motor and pump drive shafts that are joined by an appropriate coupling (not shown.)

Positioned on the interior of hollow shaft 26 is check valve or plug 38. The plug serves as a one-way valve against the back-pressure of the fluid from the discharge ports 36. The valve or plug 38 can be adapted from any of several types of commercially available landing nipples known to the art. The valve's closure member can be activated by mechanical linkage, or an electro-mechanical linkage that is controlled from the surface (not shown.) Alternatively, the position of the plug or check valve closure member can be made responsive to the axial rotation of shaft 26, so that when the motor is activated, the turning of the shaft causes the valve 38 to assume a sealed position thereby maintaining the necessary pressure to cause the fluid to be passed through the discharge openings 36 to continue its flow through the shaft 26.

The electric submersible pump of the invention provides a pump that can be installed between the sections of oil well tubing by means of rotating bearing seals 28. The assembly can be accommodated by both existing well casings and new installations having industry- standard inside diameters.

Of equal importance is the fact that the motor and pump drive shaft 26 is hollow and is axially aligned with the well tubing sections 12, 14 so that various types of wire-guided tools and other well maintenance and monitoring devices can be passed through the pump and motor with relative ease. This is in contrast to submersible pumps of the prior art which presented obstacles to the lowering and raising of wire-guided tools, or alternatively, where the pump is run parallel to the tubing in an eccentric configuration using a bypass block.

In the embodiment illustrated in the drawing, the outside diameter of the shaft 26 is less than the inside diameter of the pipe section to which it is joined in fluid communication. That is, the ends of shaft 26 are inserted into the ends of pipe sections 12 and 14. As will be apparent to one of ordinary skill in the art, the ends of shaft 26 can be the same size as the adjacent ends of tubing pipe, and the connection can be made by bearing seals mounted in a separate coupling; or the ends of shaft 26 can be larger than the tubing pipe and the connection can be made by seals 18 on the interior of shaft 26 that receive the smaller outside diameter pipe.

The bearing seals 18 are preferably of the permanently sealed, self-lubricating type. As illustrated in the drawing, roller bearings are preferred. The bearing seals 18 can be mounted in bearing supports 19 that comprise the outer ends of the motor and pump housings.

With further reference to the drawing, electrical conductor cable 15 provides power to the motor through terminal box 25. Cable 15 is also utilized to transmit signals as may be required to move landing nipple plug 38 from the closed to the open position. The design of the invention also enables use of the fluid that is being pumped through the hollow drive shaft 26 to cool the motor 20. Various methods and apparatus for cooling the motor by transfer of heat to the moving fluid are known to the art and can be adapted by one of ordinary skill to the invention.

In the embodiment illustrated in the drawing, the motor housing 21 and pump housing 31 are joined by journal bearing support 28 that contains journal bearing seal 29 that is in contact with drive shaft 26. In a preferred embodiment, the pump and motor housing and journal can be produced as a two-part casting having mating surfaces defined by a longitudinal plane passing through the axis of the shaft 26. The stator 22 is secured to the motor housing 21, the bearings 18, rotor 24, bearing seal 29 and pump impeller 32 are secured to shaft 26, and the assembly completed by joining the two longitudinally divided sections or halves of the castings, as by mechanical fasteners or by welding the seam to provide a seal. If mechanical fasteners are employed, a gasket or other such sealing material is placed between the mating surfaces. The uses of removable mechanical fasteners has the obvious advantage of facilitating the replacement of worn and damaged parts.

In accordance with well established practices, commercially available tools, gauges and the like can be run in the well tubing fitted with the invention using standard slick line and braided line equipment. It is preferred to stop the motor and the rotation of shaft 26. Check valve 38 is opened to provide an axial opening for passage of the tool or the like.

It will be understood from the above description that other modifications to the construction of the principal elements can be undertaken without departing from the teaching and scope of the invention which is defined by the claims that follow.

I claim:

1. In combination, an improved electric motor and submersible pump apparatus for assembly between a first section and a second section of axially aligned well tubing for moving a liquid through the tubing, the motor and pump combination comprising:

a) a hollow drive shaft that is mounted for rotation in axial alignment with the axis of the tubing, the drive shaft having an intake end and a discharge end and of a diameter sufficient to pass wireline logging tools and devices required to monitor and maintain the well tubing;

b) bearings mounted on the exterior of, and proximate to the ends of the hollow drive shaft;

c) a motor housing secured to the downstream end of the first section of tubing;

d) a stator secured to the interior of the motor housing;

e) a rotor mounted on the drive shaft proximate the stator;

f) a pump housing secured to the upstream end of the second section of tubing, the pump housing containing pump impellers mounted on the hollow drive shaft for rotation inside of the pump housing;

g) an annular seal between the discharge end of the pump housing and the drive shaft;

h) a plurality of intake ports in the hollow drive shaft in fluid communication with the intake end of the pump and a plurality of discharge ports in the hollow drive shaft in fluid communication with the discharge end of the pump; and i) a check valve mounted on the interior of the drive shaft between the intake ports and discharge ports said check valve having a valve closure member movable between open and closed positions.

2. The apparatus of claim 1 which further comprises a first section of tubing of predetermined length permanently mounted on the bearings at the motor end of the drive shaft and a second section of tubing of predetermined length permanently mounted on the bearing at the pump end of the drive shaft.

3. The apparatus of claim 2 where the first and second sections of tubing terminate in mounting flanges at the ends opposite the motor and pump, respectively.

4. The apparatus of claim 1 which forms a section of an oil well production tubing string.

5. The apparatus of claim 4 where the second section of tubing is a tail pipe at the end of the tubing string.

6. The apparatus of claim 1 in which the drive shaft comprises a landing nipple and the check valve is mounted in the landing nipple.

7. The apparatus of claim 6 where the diameter of the check valve seat is sufficient to permit the passage of wire line tools through the hollow drive shaft.

8. The apparatus of claim 6 in which the check valve closure member is operable in response to electrical signals and the apparatus further comprises an electrical controller positioned remote from the check valve and electrical conductors extending between the controller and the motor and check valve, whereby the position of the check valve closure member moves in response to electrical signals from the controller.

9. The apparatus of claim 6 in which the check valve is a plug in a landing nipple.

10. The apparatus of claim 1 in which the motor and pump housings are generally cylindrical.

11. The apparatus of claim 10 where the diameter of the pump and motor housings does not exceed about eight inches.

12. The apparatus of claim 10 which will pass through petroleum industry-standard oil well casing pipe.

13. The apparatus of claim 1 where the motor housing and the pump housing are of integral construction.

14. The apparatus of claim 13 which further comprises a journal and a bearing seal positioned intermediate the pump and motor housings.

15. The apparatus of claim 13 where the pump and motor housings are comprised of two longitudinally divided sections that are joined to form an integral unit.

16. The apparatus of claim 1 where the bearings are mounted on the exterior of the hollow drive shaft.

17. The apparatus of claim 1 which further comprises means for securing the pump and motor housings to the respective proximate ends of the stationary tubing sections.

18. The apparatus of claim 1 which further includes check valve activation means for moving the valve closure member between open and closed positions.

19. A combination plug landing nipple and electrical submersible pump and motor apparatus for down-hole use in a tubing string of a well comprising:

a) a plug landing nipple having an upstream end and a downstream end and of a diameter sufficient to pass wireline logging tools and devices required to monitor and maintain the well tubing;

b) bearings mounted proximate the ends of the landing nipple, said bearings permitting axial rotation of the landing nipple;

c) a motor housing containing a stator, the motor housing mounted on the bearings at one end of the landing nipple, said stator surrounding a portion of the landing nipple;

d) a rotor fixedly mounted on the landing nipple proximate the stator;

e) a pump housing mounted on the bearings at the end of the landing nipple opposite the motor and extending towards the motor housing;

f) pump impellers fixedly mounted on the landing nipple and inside of the pump housing;

g) an annular seal between the discharge end of the pump housing and the landing nipple;

h) a plurality of intake ports in the wall of the landing nipple upstream of the plug and in fluid communication with the intake end of the pump housing and a plurality of discharge ports in the wall of the landing nipple downstream of the plug and in fluid communication with the discharge end of the pump housing; and i) means for altering the position of the plug in the landing nipple.

20. The apparatus of claim 19 where the bearings are mounted on the exterior of the ends of the landing nipple.

21. The apparatus of claim 19 where the means for altering the position of the plug in the landing nipple is a wireline.

22. The apparatus of claim 19 where the means for altering the position of the plug in the landing nipple is responsive in response to the rotation of the nipple.

23. The apparatus of claim 19 which further comprises fluid conduits in the motor that are in communication with the interior of the nipple for passing fluid in heat exchange relation with the motor.

24. An improved method of assembling a down-hole electric submersible pump and motor in a production tubing string for use in a well casing to permit the passage of wire-guide tools to a position in the tubing string upstream of the pump, the method comprising:

a) providing an electric submersible pump and motor of generally cylindrical configuration, each having a maximum outside diameter less than the inside diameter of the well casing, said pump having a hollow drive shaft extending from the motor and a concentrically mounted rotor and pump impellers, a check valve mounted on the interior of the hollow drive shaft between the pump intake and pump discharge, said check valve being in a closed position when the pump is operating, said hollow drive shaft having inlet ports in fluid communication with the inlet of the pump and outlet ports in fluid communication with the discharge of the pump and said hollow drive shaft having a diameter sufficient to pass wireline logging tools and devices required to monitor and maintain the well tubing;

b) providing activation means in association with the check valve to move the check valve from a closed to an open position;

c) providing electrical conductors to the motor;

d) assembling the upstream end of the hollow drive shaft for rotational movement in axial alignment to the downstream end of a down-hole tubing string positioned axially in the well casing;

e) assembling the downstream end of the hollow drive shaft of the pump for rotational movement in axial alignment to the upstream end of a second length of tubing;

f) securing the pump and motor to the ends of the adjacent sections of tubing; and g) lowering the assembled tubing string and electric submersible pump into the well casing, whereby the check valve can be opened to permit the passage of wire-guide tools through the hollow drive shaft of the electric submersible pump.

25. The method of claim 24 which comprises the further step of attaching a mechanical linkage to the check valve activation means.

26. The method of claim 24 which comprises the further step of cooling the motor with a fluid that passes through the tubing string.

27. The method of claim 26 in which the motor is cooled by direct heat exchange with the fluid.

28. In combination, an improved electric motor and submersible pump apparatus for assembly between a first section and a second section of axially aligned well tubing for moving a liquid through the tubing, the motor and pump combination comprising:

a) a hollow drive shaft for rotation in axial alignment with the axis of the tubing, the drive shaft having an intake end and a discharge end and of a diameter sufficient to pass wireline logging tools and devices required to monitor and maintain the well tubing;

b) a motor housing;

c) a stator secured to the interior of the motor housing;

d) a rotor mounted on the drive shaft proximate the stator;

e) a pump housing having an intake and a discharge end containing pump impellers mounted on the hollow drive shaft for rotation inside of the pump housing;

f) a plurality of intake ports in the hollow drive shaft in fluid communication with the intake end of the pump and a plurality of discharge ports in the hollow drive shaft in fluid communication with the discharge end of the pump; and g) a closure member mounted on the interior of the drive shaft between the intake ports and discharge ports, said closure member preventing passage of fluid through the drive shaft between the intake and discharge ports when the fluid is being pumped.

29. The apparatus of claim 28 in which the closure member comprises a movable element in a check valve mounted on the interior of the drive shaft.

30. The apparatus of claim 29 in which the drive shaft comprises a landing nipple and the check valve is mounted in the landing nipple.

31. The apparatus of claim 28 where the pump housing is mounted on the hollow drive shaft upstream of the motor housing.

32. The apparatus of claim 28 which further comprises a bearing seal between the pump and motor housings and engaging the drive shaft.

* * * * *